US006318649B1

(12) United States Patent
Mazurkiewicz

(10) Patent No.: US 6,318,649 B1
(45) Date of Patent: Nov. 20, 2001

(54) METHOD OF CREATING ULTRA-FINE PARTICLES OF MATERIALS USING A HIGH-PRESSURE MILL

(75) Inventor: Marian Mazurkiewicz, Rolla, MO (US)

(73) Assignee: Cornerstone Technologies, LLC, Wilkes Barre, PA (US)

( * ) Notice: Subject to any disclaimer, the term of this patent is extended or adjusted under 35 U.S.C. 154(b) by 0 days.

(21) Appl. No.: 09/413,489

(22) Filed: Oct. 6, 1999

(51) Int. Cl.[7] ..... B02C 19/00

(52) U.S. Cl. ..... 241/5; 241/16; 241/29; 241/39; 241/40; 241/152.2

(58) Field of Search ..... 241/1, 16, 5, 39, 241/40, 29, 152.2

(56) References Cited

U.S. PATENT DOCUMENTS

| | | | |
|---|---|---|---|
| 2,991,946 | 7/1961 | Croft . | |
| 3,058,673 | 10/1962 | Firing . | |
| 3,595,486 | 7/1971 | Stephanoff | 241/5 |
| 3,608,835 | 9/1971 | Ruzicka . | |
| 3,837,583 * | 9/1974 | Kugelberg et al. | 241/39 |

(List continued on next page.)

FOREIGN PATENT DOCUMENTS

| | | |
|---|---|---|
| 1052782 | 3/1959 | (DE) . |
| 806771 | 12/1936 | (FR) . |
| 10137618 | 5/1998 | (JP) . |
| WO 97/30790 | 8/1997 | (WO) . |
| WO 00/09267 | 2/2000 | (WO) . |

OTHER PUBLICATIONS

Summers, D.A. and Mazurkiewicz, M. *The Effect of Jet Traverse Velocity on the Cutting of Coal and Jet Structure*, May, 1976, Third International Symposium on Jet Cutting Technology, pp. D5–51–D5–64.

Summers, David A. et al., *Experimentation in Hydraulic Coal Mining*, Mar., 1997, AIME Annual Meeting, Society of Mining Eingeneers of AIME, pp. 1–20.

Mazurkiewicz, M. and Summers, D.A., *The Enhancement of Cavitation Damage and its Use in Rock Disintegration*, Apr., 1982, Sixth International Symposium on Jet Cutting Technology, pp. 27–38.

Mazurkiewicz, M., *The Separation of Wood Fibers by a High Pressure Water Jet*, Jun., 1984, Seventh International Symposium on Jet Cutting Technology, pp. 389–394.

(List continued on next page.)

*Primary Examiner*—Allen M. Ostrager
*Assistant Examiner*—William Hong
(74) *Attorney, Agent, or Firm*—Sterne, Kessler, Goldstein & Fox PLLC

(57) ABSTRACT

A method for creating ultra-fine particles of material using a high-pressure mill is described. The method includes placing a material in a first chamber and subjecting the material to a high-pressure liquid jet to divide it into particles. These particles are then transferred to a second chamber in which they are subjected to cavitation to further divide the particles into relatively smaller particles. These relatively smaller particles are then transferred to a third chamber, in which the particles collide with a collider to still further divide them into ultra-fine particles of the material. The mill of the present invention includes a first chamber having an high-pressure liquid jet nozzle, first and second slurry nozzles, a second cavitation chamber and a third chamber which houses a collider. Sensors may be located throughout the mill to collect data on the comminution process and to use the data to control the resultant particle size. The product size of the ultra-fine particles made according to the mill of the present invention are preferably less than 15 microns.

19 Claims, 10 Drawing Sheets

U.S. PATENT DOCUMENTS

| | | | | |
|---|---|---|---|---|
| 3,973,733 | | 8/1976 | Switzer | 241/1 |
| 4,119,160 | | 10/1978 | Summers et al. | 175/67 |
| 4,146,366 | | 3/1979 | Keller | 41/1 |
| 4,186,772 | * | 2/1980 | Handlman | 137/604 |
| 4,323,198 | | 4/1982 | Turner et al. | 241/5 |
| 4,337,899 | | 7/1982 | Selberg | 239/543 |
| 4,546,925 | | 10/1985 | Spiro | 241/1 |
| 4,619,406 | | 10/1986 | Fishgal . | |
| 4,723,715 | | 2/1988 | Mazurkiewicz | 241/1 |
| 4,871,117 | | 10/1989 | Bauereggger et al. | 241/23 |
| 4,930,707 | * | 6/1990 | Oshiro et al. | 241/5 |
| 4,986,479 | | 1/1991 | Swarden et al. | 241/15 |
| 5,012,984 | | 5/1991 | Ishikawa et al. | 241/16 |
| 5,035,362 | | 7/1991 | Mazurkiewicz | 241/1 |
| 5,086,974 | | 2/1992 | Henshaw | 239/101 |
| 5,086,982 | * | 2/1992 | Hirano et al. | 241/40 |
| 5,199,512 | | 4/1993 | Curlett | 175/67 |
| 5,217,163 | | 6/1993 | Henshaw | 239/101 |
| 5,291,957 | | 3/1994 | Curlett | 175/67 |
| 5,358,183 | * | 10/1994 | Kanda et al. | 241/5 |
| 5,542,613 | * | 8/1996 | Nied | 241/5 |
| 5,562,253 | * | 10/1996 | Henderson et al. | 241/5 |
| 5,660,335 | | 8/1997 | Köppl et al. | 241/1 |
| 5,716,751 | * | 2/1998 | Bertrand et al. | 430/137 |
| 5,732,893 | * | 3/1998 | Nied | 241/39 |
| 5,765,766 | * | 6/1998 | Yoshida et al. | 241/39 |
| 5,765,924 | | 6/1998 | Liesveld | 299/15 |
| 5,799,881 | * | 9/1998 | Urata et al. | 241/5 |
| 5,855,326 | | 1/1999 | Beliavsky | 241/5 |
| 5,931,771 | * | 8/1999 | Kozyuk | 516/53 |

OTHER PUBLICATIONS

Mazurkiewicz, M. and Summers, D.A., *The Use of High Pressure Water Jets as a High Efficiency Tool for Coal Comminution*, Mar., 1985, Rock Mechanics and Explosives Research Center at the University of Missouri—Rolla, pp. 717–729.

Galecki, G., and Mazurkiewicz, M., *Direct Injection of Coal into Cavitation Cell for Purpose of Comminution*, Oct., 1988, Ninth International Symposium on Jet Cutting Technology, pp. 411–422.

Mazurkiewicz, M. and Galecki, G., *Coal and Minerals Comminution with High Pressure Waterjet Assistance*, May, 1993, XVIII International Mineral Processing Congress, pp. 131–138.

Wright, D. et al., *A Study of Rotary Jets for Material Removal*, Aug., 1997, Ninth Annual American Waterjet Conference, pp. 525–539.

Mei, Fang et al., "A New Type of High Pressure Water Jet Mill,", Proceedings of the 10$^{th}$ American Waterjet Conference, vol. I, Aug. 14–17, 1999, Houston, TX, pp. 431.440.

Mei, Fang et al., "Mica Particle Size Dimension Distribution After Water Jet Comminuting,", Proceedings of the 10$^{th}$ American Waterjet Conference, vol. I, Aug. 14–17, 1999, Houston, TX, pp. 441–450.

Hov et al., *Theoretical Analysis of a Jet–Driven Helmholtz Resonator and Effect of its Configuration on the Waterjet Cutting Property.*, Oct. 4–6, 1988, 9$^{th}$ International Symposium on Jet Cutting Technology, pp. 189–201.

Zhonghou et al., *Theory of Vortex and Design of Self–Resonating Jet Nozzles,* Nov. 30–Dec. 2, 1992, The Third Pacific Rim International Conference on Water Jet Technology, pp. 255–263.

* cited by examiner

METHOD OF CREATING ULTRA-FINE PARTICLES OF MATERIALS USING A HIGH-PRESSURE MILL

BACKGROUND OF THE INVENTION

1. Field of the Invention

The present invention relates to a method for creating ultra-fine particles of a material using high-pressure fluid and a mill for implementing the method. More particularly, the present invention relates to a method and- apparatus for subjecting particles to a high-pressure liquid jet, high turbulence condition, cavitation and collision to comminute the particles.

2. Related Art

Comminution may be defined as either a single or multistage process by which material particles are reduced from random sizes by crushing and grinding to the size required for the intended purpose.

Size reduction in comminution machines relies on three different fragmentation mechanisms: cleavage, shatter, and abrasion. It is commonly stated that only three percent of the energy used in fragmenting solid particles goes into the creation of new surfaces. Thus, current comminution technology is both energy-intensive and inefficient.

During milling of material, to create a fracture in the particles of material, a stress must be induced which exceeds the fracture strength of the material. The mode of fracture and the path that it follows depends on the material, the shape and structure of the particle, and on the way and rate at which the load is applied. The way in which the load is applied will control the stresses that induce fracture extension or growth within the particle. The force used to induce this growth can be one of simple compression, which causes the particle to fracture in tension, whether at a slow or fast rate. Alternatively, the applied load may be in shear, such as is exerted when two particles rub against each other, or the load may be applied as a direct tensile force on the particle.

For optimum comminution of hard materials such as minerals a shattering fracture is most beneficial. This occurs when the energy applied to the particle is well in excess of that required for fracture. Under these conditions, very rapid crack growth is induced and will cause crack bifurcation. Thus, the multiplicity of areas in the particle that are simultaneously overstressed will combine to generate a comparatively large number of particles with a wide spectrum of sizes. Shattering usually occurs under conditions of rapid loading (e.g., a high velocity impact) with maximum size reduction occurring around the impact points. According to existing theory, the finest product sizes are generated in the zone around the impact point, when insufficient energy is applied to cause total fracture of the particle. The localized nature of the applied stress and the high energy required for this ultra-fine grinding make this process relatively inefficient.

Conventional milling machines use mechanical crushing or crushing and attriting to break mineral particles into smaller particles. The low efficiency of existing reduction processes is frequently due to the application of stress where there are no particles. The result is that much of the energy input is wasted in non-productive contact between, for example, crushing mechanisms or between a crushing mechanism and the mill wall, both of which lower the overall energy efficiency of the process.

Further, for brittle materials, there is a considerable difference between the values of uniaxial compressive strength and tensile strength of the material. Thus, the amount of energy which must be consumed in breaking the mineral into small particles under compressive loading is substantially higher than that required if the material can be induced to fail under a tensile stress. To induce simple tensile failure, high pressure liquid jets or different liquid jets have been used in comminution processes.

Size reduction involves rupturing the chemical bonds within the material in order to generate new surfaces. Thus, the chemical processes associated with fracture will significantly affect the energy required to induce this fracture. This influence extends beyond the bonds themselves to include the surrounding environment. For example, the presence of liquid at the crack tip will lower the forces required to expand the crack and improve efficiency, especially where the liquid contains inorganic ions and organic surfactant. One explanation for this effect is that the additives penetrate into microcracks ahead of the major crack front and thus take part in the highly reactive events that occur during fracture. Because the capillary flow of these liquids into the material ahead of the main front runs at the velocity of crack propagation it provides a means of transmitting energy more easily within the crack tip zone. A high-pressure liquid jet containing chemical additives creates extremely dynamic conditions in which microcracks grow ahead of the main failure plane and become pressurized, thereby enhancing any chemical changes which might occur.

For use in liquid-fueled power plants, it is necessary to produce a homogeneous, pumpable suspension of coal that will not settle in delivery lines and which burns at the required rate. Therefore, the coal must be ground from the "standard plant size" to a diameter below 40 microns. Among the many milling methods used for this process the finest product is achieved by the use of autogenous attriting machines. The distinguishing feature of these machines is that size reduction is effected by particles impacting upon each other, after being given the necessary energy to induce fragmentation through a solid or liquid impeller. Included in this class are the following systems: (1) Buhrstones—which cause comminution through an abrasion action; (2) Colloid Mills—in which comminution occurs by collision between particles; (3) Fluid Energy Mills—in which particles interact upon one another; and (4) Sand Grinder—in which particles are reduced by contact with sand particles.

The advantage of the conventional equipment is that the product is reduced to very small sizes (below 40 microns) and distributed within a narrow size range. The equipment, however, can only operate, at any one time, with small quantities of feed, and the initial feed size of particles lies in the range between 0.5 inches and 50 microns, depending on the type of unit. For the sand grinder, for example, the feed stock should already be crushed to below 70 microns. A much greater disadvantage for this type of machine is the very high power consumption required to achieve the required crushing.

The energy required to achieve a given size reduction increases as the product size decreases. This increase is due to many factors and is a consequence not only of the type of mill or the microscopic condition of the material, but also relates to the mechanism of failure at the individual particle level. This is obvious because fragmentation in a chamber is partly brought about by an interaction between the particles and the chamber wall.

In such situations, the treatment of individual particles requires special attention. For example, a coal particle is anisotropic, heterogeneous, and extensively pre-cracked.

Physical properties of coal vary as a function of the degree of metamorphism of the coal particle. Because of the organic nature of the material, this means that different properties may be encountered, even within a single particle. Under such a situation an analytical approach to coal fragmentation is very complex.

The efficiency of coal comminution depends on the ability to take advantage of the anisotropy of coal particles which is, in turn, a function of the internal structure. However, with liquid jet comminution, failure occurs on the basis of differential coal porosity and permeability, as these properties control the specific rates of liquid absorption, which directly influence the rate of disintegration.

Experiments conducted with shaped explosive charges to investigate fracture formation in coal showed that there is intense fracturing of coal near the jet path, with this zone of fracture usually bounded by joints, bedding planes and cleat planes. The coal breaks into large and small pieces, usually parallel following natural cleavage planes. Beyond this intensely crushed zone, some large fractures were observed. These crossed joints and traveled long distances, while fractures originating at the base of the jet penetration also crossed bedding planes and extended the zone of influence deeper into the target material.

Comminution technology can also be used to comminute organic materials. One example of such a material is wood. These organic materials are generally softer than the inorganic materials discussed above. In the case of organic materials, the impact of the waterjet causes a shearing force to occur to break apart the material, rather than the crack propagation discussed above.

Conventional comminution technology is both energy intensive and inefficient. Up to 97% of the energy consumed during the operation of conventional size reduction devices can go into non-productive work, with only 3% of the energy input then being used to create new surfaces. Comminution is thus an appropriate target for significant energy savings, since the tonnages of materials involved in the size reduction operations are so great that even small improvements in comminution efficiency would provide considerable savings in energy and mineral resources.

Further, conventional comminution devices are very expensive and wearing process of the friction parts are very significant and costly.

Through study it has been found that a high-pressure liquid jet has an excellent, and in some ways a unique, ability to improve material disruption. Such a capability is due to the following features:

- A liquid jet of 10,000 psi pressure moves at approximately 1,332 ft/sec, with a narrowjet diameter providing a concentrated energy flux input to the target.
- The high energy density of the liquid jet is concentrated in a very small impact zone, while the intense differential pressure across the jet enhances microcrack generation and growth.
- Subsequent to the initial impact, the jet stagnation pressure forces liquid into the cracks and microcracks. It develops a hydromechanical jet action in these cracks and creates an increasingly dense network of cracks in the walls of the cavity created.
- Rapid jet penetration into pre-cracked minerals can be enhanced by the use of surface active agents, which will also work to further comminute the coal and retreat any mineral matter in the coal.
- In those circumstances where a coal/oil mixture (COM) is required, the liquid jet can be changed to an oil jet, for example, to eliminate the intermediate drying process.
- The separation of mineral matter from coal is improved by use of pressurized liquid jets. On occasion, this separation is enhanced by the differential response of the constituent materials to the jet attack which can facilitate separation of the resulting particles on the basis of the size differential in the grain or crystal sizes of these materials.
- There is a reduced expectation of mechanical wear or process contamination of the product.

Conventional jet energy mills have a size reduction factor of approximately 50. This means that conventional mills can reduce the size of a particle so that the product size of the final, resultant particles is 50 times smaller than the original feed size of the particles. What is needed is a mill that makes efficient use of high-pressure liquid jets in the comminution of materials into ultra-fine particles.

SUMMARY OF THE INVENTION

The present invention relates to a high pressure jet energy mill that is designed to achieve a size reduction factor of approximately 500 and that has relatively lower energy consumption than conventionaljet energy mills. The mill of the present invention includes a first chamber in which a material is subjected to a high-pressure liquid jet attack to achieve comminution of the material. The comminuted particles are then transferred via a primary slurry nozzle to a second chamber, in which the particles undergo cavitation in a cavitation chamber. The particles are then transferred via a secondary slurry nozzle to a third chamber, in which the particles are caused to collide with a stable collider or an ultrasonically vibrating collider to cause further comminution of the particles. The position of this collider, with respect to the secondary slurry nozzle can be adjusted to affect the comminution process. Further, in one embodiment, self-resonating elements can be placed in various chambers in the mill to cause further comminution of the particles. The product size of the resultant particles is preferably less than 15 microns.

In another embodiment of the invention, the mill includes a first chamber in which a material is subjected to a high-pressure liquid jet to achieve comminution of the material. A similar, second chamber is disposed exactly opposite the first chamber. The slurry from each of the first and second chambers is transferred to a third central chamber, located between the first and second chambers, via nozzles, such that the jets from each nozzle undergo a high velocity collision to cause further comminution of the particles.

A mill and data control system can also be used to implement the present invention. In such a system, temperature, pressure and/or sound sensors can be located throughout the mill to measure characteristics of the system during particle processing. This data can be transferred to a processor for storage and/or used for feedback to different portions of the mill to control the comminution process. Other sensors used in the control system include a particle size sensor at the outlet of the mill to measure the size of the resultant particles, and a linear variable differential transducer to measure the position of the collider in the third chamber of the mill.

As such, one object of invention is to comminute a material into an ultrafine particle size in a consistent and energy efficient manner.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
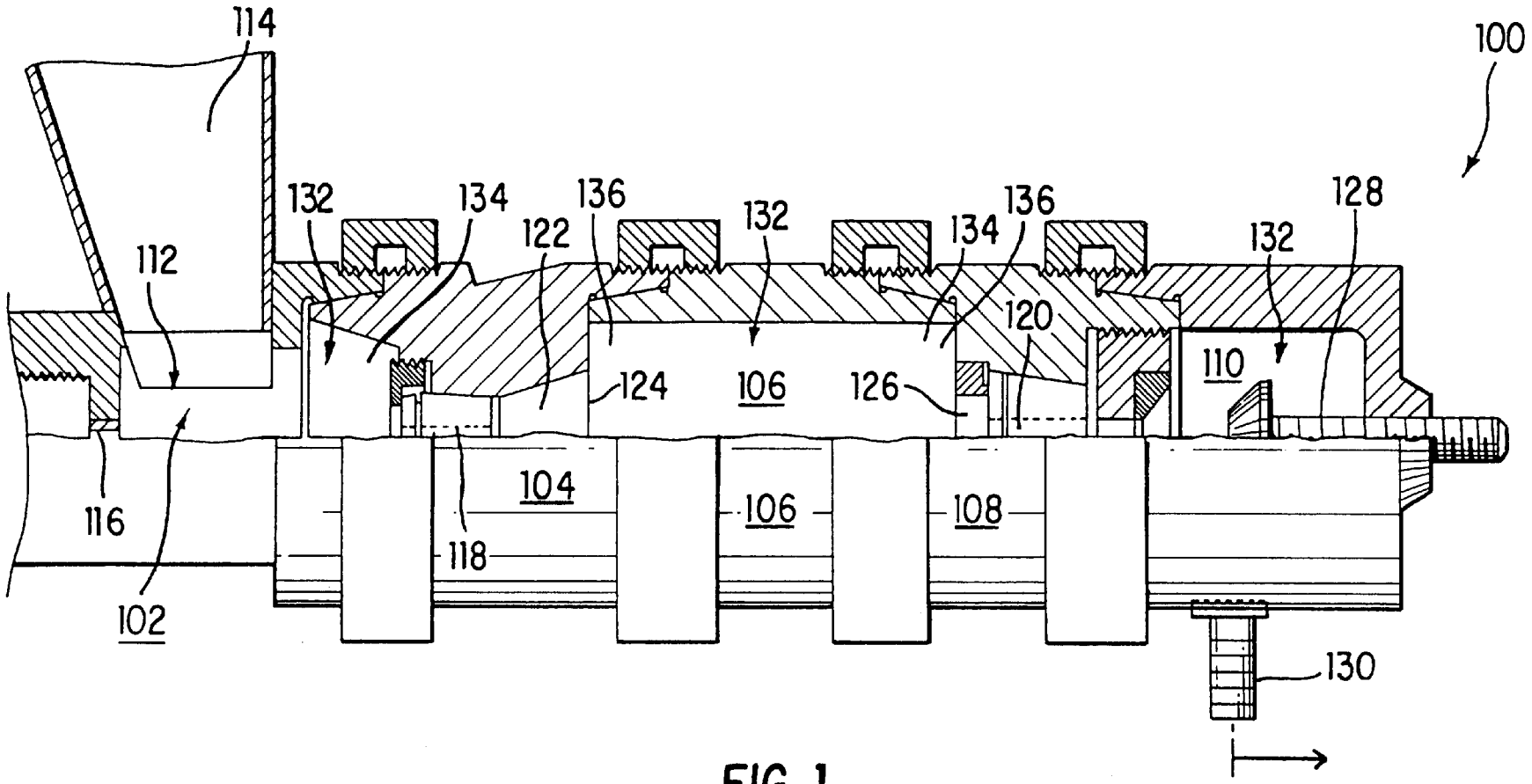
FIG. 1 shows a first embodiment of a mill of the present invention for the comminution of materials.

FIG. 1 shows a first embodiment of a high-pressure mill 100 for processing materials into ultra-fine particles. Mill 100 includes a first chamber 102, nozzle chambers 104 and 108, a second chamber 106, and a third chamber 110. In one embodiment, chambers 102, 106 and 110 each have a length (measured from inlet to outlet) in the range of 1–20 inches and a diameter in the range of 0.25–10 inches. However, it would be apparent to one skilled in the relevant art that various other sizes and configurations of chambers 102, 106 and 110 could be used to implement mill 100 of the present invention.

First chamber 102 includes an inlet 112. The material to be processed is fed into first chamber 102 via inlet 112. In this embodiment, a funnel 114 is disposed above inlet 112 to facilitate loading of the material to be processed into first chamber 102. In an alternate embodiment, inlet 112 could be connected via a port to an outlet of another similar mill, so that the particles exiting a first mill could be pumped into a second stage mill to achieve further comminution of the particles. The second stage mill could be designed with the same chambers and features as the first mill, however, the nozzle sizes would be smaller than the first mill to accommodate the reduced size of the particles.

As the material particles are processed, the volume of liquid in the slurry increases, thereby decreasing the comminution effect of the liquid jets. As such, in another embodiment, the slurry exiting mill 100 could be processed in a centrifuge to eliminate the excess liquid and make the slurry more concentrated before it is fed into the second stage mill, as described above.

In one embodiment, the material to be processed is anthracite, commonly known as coal, having a starting size, also referred to as a feed size, of 600–1,200 microns. Although this is a preferable range for the feed size, the feed size could be less than 600 microns and could be as high as 0.5 inches.

It would be apparent to one skilled in the relevant art that the present mill 100 could be used to process a variety of other materials, both organic and inorganic, having various feed sizes. For example, the mill of the present invention could be used to process any of the following: silica carbides for abrasive use; various silica compounds for high density ceramics; garnet for abrasive and cutting uses; alumina for abrasive and structural ceramic uses; coke and coke by-products; metal powders such as magnetite, zinc, copper, brass and nickel; mica; vermiculite; silicon dioxide; carbon black; and any other brittle material that needs to be finely ground. Further, the mill of the present invention could be used to process a variety of organic materials, including, for example: wood, food products and products for use as pharmaceuticals.

In one embodiment, the material particles are dry as they are fed into first chamber 102. In another embodiment, the material particles could be fed into first chamber 102 as part of a slurry, e.g., a mixture of material particles and a liquid, such as water or oil.

First chamber 102 further includes a high-pressure liquid jet nozzle 116. Liquid jet nozzle 116 preferably creates a water jet, however, it would be apparent to one skilled in the relevant art that other liquids could also be used. The liquid jet generated by nozzle 116 is configured in first chamber 102 such that the jet of liquid exiting from liquid jet nozzle 116 impacts or collides with the material particles after they enter inlet 112 to effect comminution of the material. In the example of processing coal, the nozzle diameter is preferably in a range between 0.005 to 1 inches, and more preferably in the range of 0.005 to 0.060 inches. The nozzle diameter is directly related to the pressure of the liquid stream available through high pressure liquid jet nozzle 116. As such, the range of nozzle diameters described above is suitable for a pressure range of liquid of 100,000–5,000 psi, respectively. It would be apparent to one skilled in the art that the nozzle diameter could be larger than the above-mentioned range, depending on the size of the pump used to create the available pressure range for the liquid jet. As such, as the amount of pump pressure capable of being achieved increases, the diameter of the nozzle can be increased, in relation thereto, when the volume of the liquid supply is sufficient.

In this embodiment, the nozzle of high-pressure liquid jet nozzle 116 is configured to emit a jet of liquid in the general direction of nozzle chamber 104. One or more liquid jet nozzles 116 can be disposed in first chamber 102. If more than one liquid jet nozzle 116 is used, the plurality of liquid jet nozzles can be arranged in a straight line through first chamber 102, thereby directing each jet of liquid toward nozzle chamber 104. In one embodiment, the liquid jets from the multiple nozzles are arranged so that the jets are emitted substantially in parallel to each other. In an alternate embodiment, the liquid jets are designed to converge with each other. As the jet(s) of liquid impact the material, the particles are broken into smaller particles, and the slurry, i.e., the combination of the smaller particles and liquid, is forced into nozzle chamber 104.

Nozzle chamber 104 includes a primary slurry nozzle 118. Primary slurry nozzle 118 creates a jet of the slurry, and delivers the slurry jet into second chamber 106. Primary slurry nozzle 118 further creates turbulence in second chamber 106, which causes the smaller particles of the material to interact with each other and comminute further. In one embodiment, primary slurry nozzle 118 has a diameter in a range of 0.010–1 inch, and preferably within a range of 0.010–0.120 inches. The size of nozzle 118 is directly related to the size of liquid jet nozzle 116. As such, as the size of liquid jet nozzle 116 increases, so does the resultant size of slurry nozzle 118.

Figure 2:
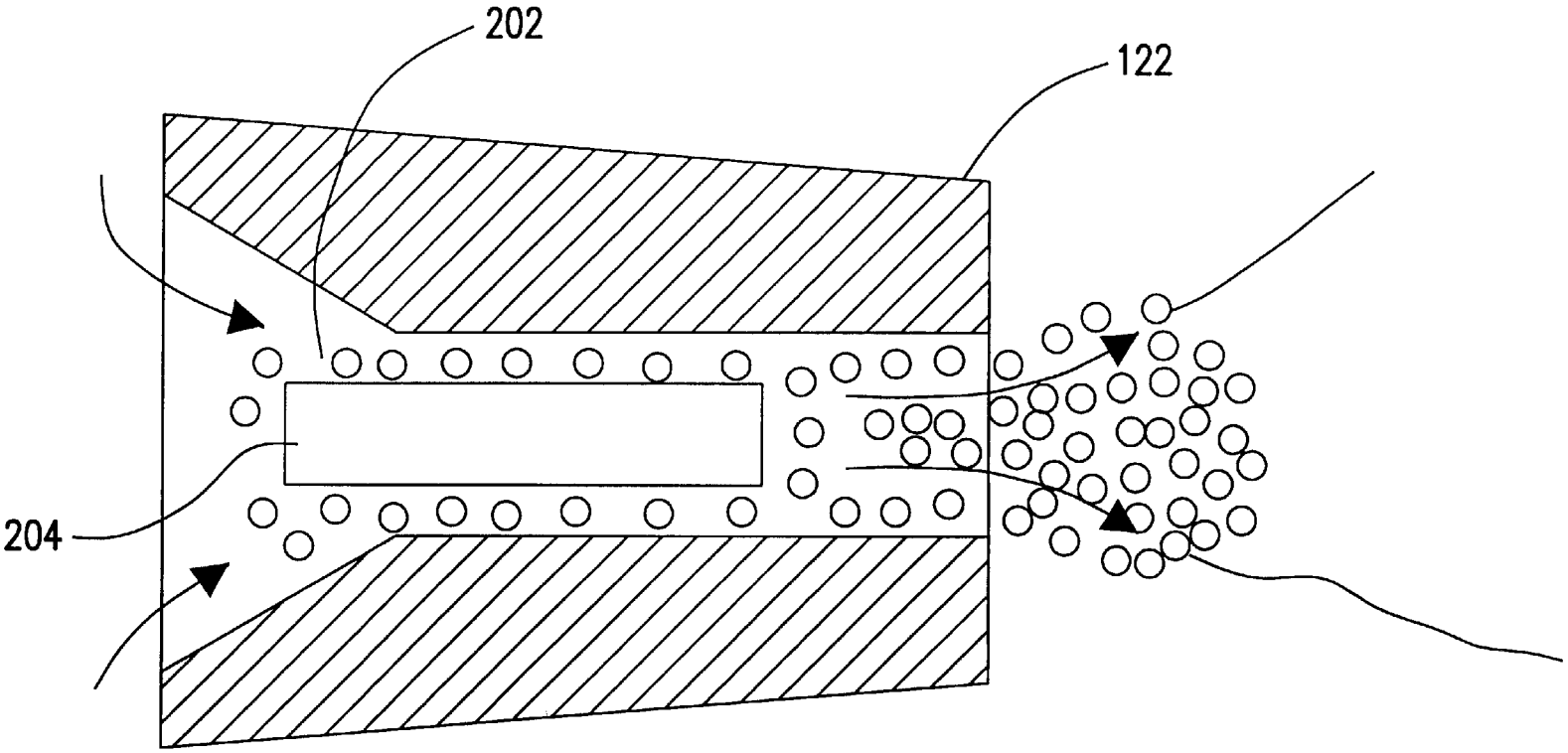
FIG. 2 shows a cross-sectional view of a cavitating nozzle of the mill of FIG. 1.

In one embodiment, nozzle chamber 104 further includes a cavitation nozzle 122. Cavitation nozzle 122 is shown in further detail in FIG. 2. As shown in FIG. 2, cavitation nozzle 122 has a channel 202 through which high velocity liquid flows. Cavitation nozzle 122 further includes an inner pin 204. In use, a hydrodynamic shadow is created in front of inner pin 204 that creates a pocket in which the flow is not continuous. Evaporation occurs in this pocket which creates cavitation bubbles in the liquid as it exits cavitation nozzle 122.

Cavitation nozzle 122, as shown in FIG. 1, is disposed adjacent second chamber 106. As such, as the slurry is passed through primary slurry nozzle 118 and into second chamber 106, the cavitation bubbles from the liquid exiting cavitation nozzle 122 implode and generate a local shock wave in second chamber 106. The shock wave acts on the particles in the slurry and causes them to comminute further. As such, the particle size of the material entering second chamber via an inlet 124 is larger than the particle size as the particles exit second chamber 106 via an outlet 126.

A secondary slurry nozzle 120 is disposed adjacent outlet 126 of second chamber 106. Secondary slurry nozzle 120 creates a second jet of slurry as it passes through the nozzle. In one embodiment, the diameter of secondary slurry nozzle 120 is within a range of 0.010–1 inch, and preferably within a range of 0.010–0.120 inches. Again, as discussed above with respect to primary slurry nozzle 118, the size of secondary slurry nozzle 120 is also related directly to the size of the high-pressure liquid jet nozzle 116.

Figure 9A:
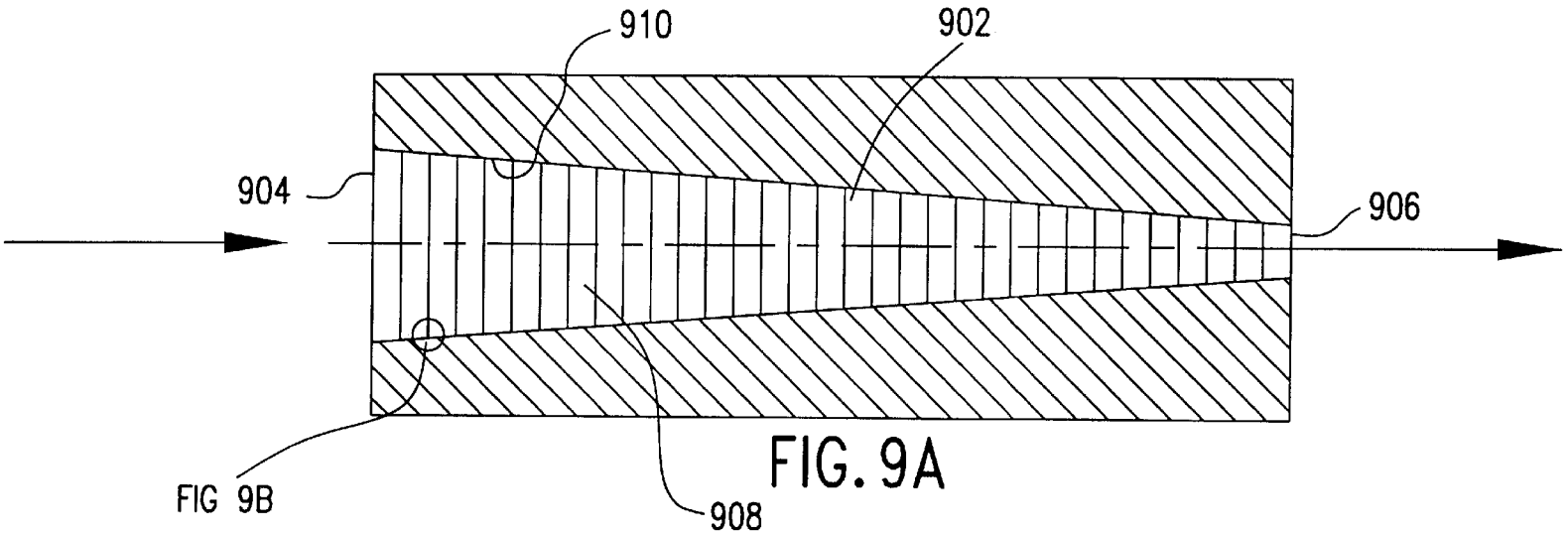
FIG. 9 shows an alternate embodiment of a slurry nozzle of the present invention.
Figure 10:
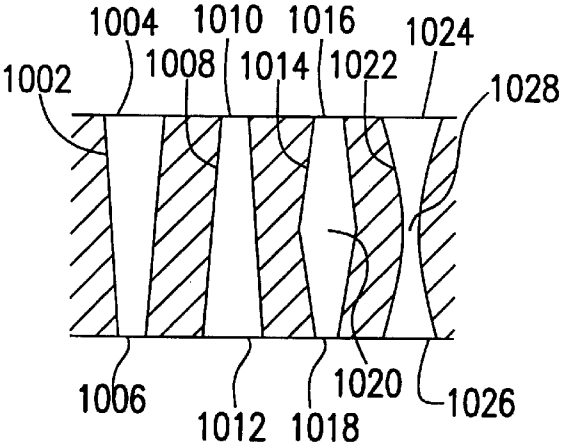
FIG. 10 shows alternate embodiments of slurry nozzles of the present invention.
Figure 9B:
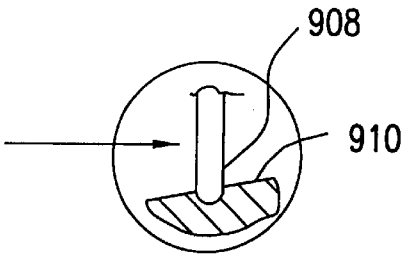

Various embodiments of slurry nozzles are shown in FIGS. 9 and 10. In particular, FIG. 9 shows an embodiment of a slurry nozzle 902 that has an inlet 904 and an outlet 906, where diameter of inlet 904 is larger than the diameter of outlet 906. Further, an inner surface 910 of slurry nozzle 902 has sharp edges 908 that project slightly out from the inner surface. In this embodiment, sharp edges 908 are formed as rings and are disposed at intervals around inner surface 910 of slurry nozzle 902. As the particles travel through slurry nozzle 902, they hit one or more of the sharp edges 908, which causes further comminution of the particles.

FIG. 10 shows various possible embodiments of channel design for the slurry nozzles used in the present invention. In a first slurry nozzle 1002, an inlet 1004 has a diameter larger than an outlet 1006, similar to nozzle 902 of FIG. 9. In a second design, slurry nozzle 1008 has an inlet 1010 with a diameter which is smaller than the diameter of its outlet 1012. A third slurry nozzle 1014 has an inlet 1016 and an outlet 1018 of approximately the same diameter, however, the inner surface of nozzle 1014 gradually tapers out from inlet 1016 toward a center point 1020 and then gradually tapers back in from center point 1020 toward outlet 1018. A fourth slurry nozzle 1022 also has an inlet 1024 and an outlet 1026 of approximately the same diameter. In this embodiment, the inner surface of nozzle 1022 gradually curves inwardly from inlet 1024 toward a center point 1028, and then gradually curves back outwardly from center point 1028 to outlet 1026. It would be apparent to one skilled in the relevant art that various other nozzle designs could also be used to implement the present invention.

Figure 5:
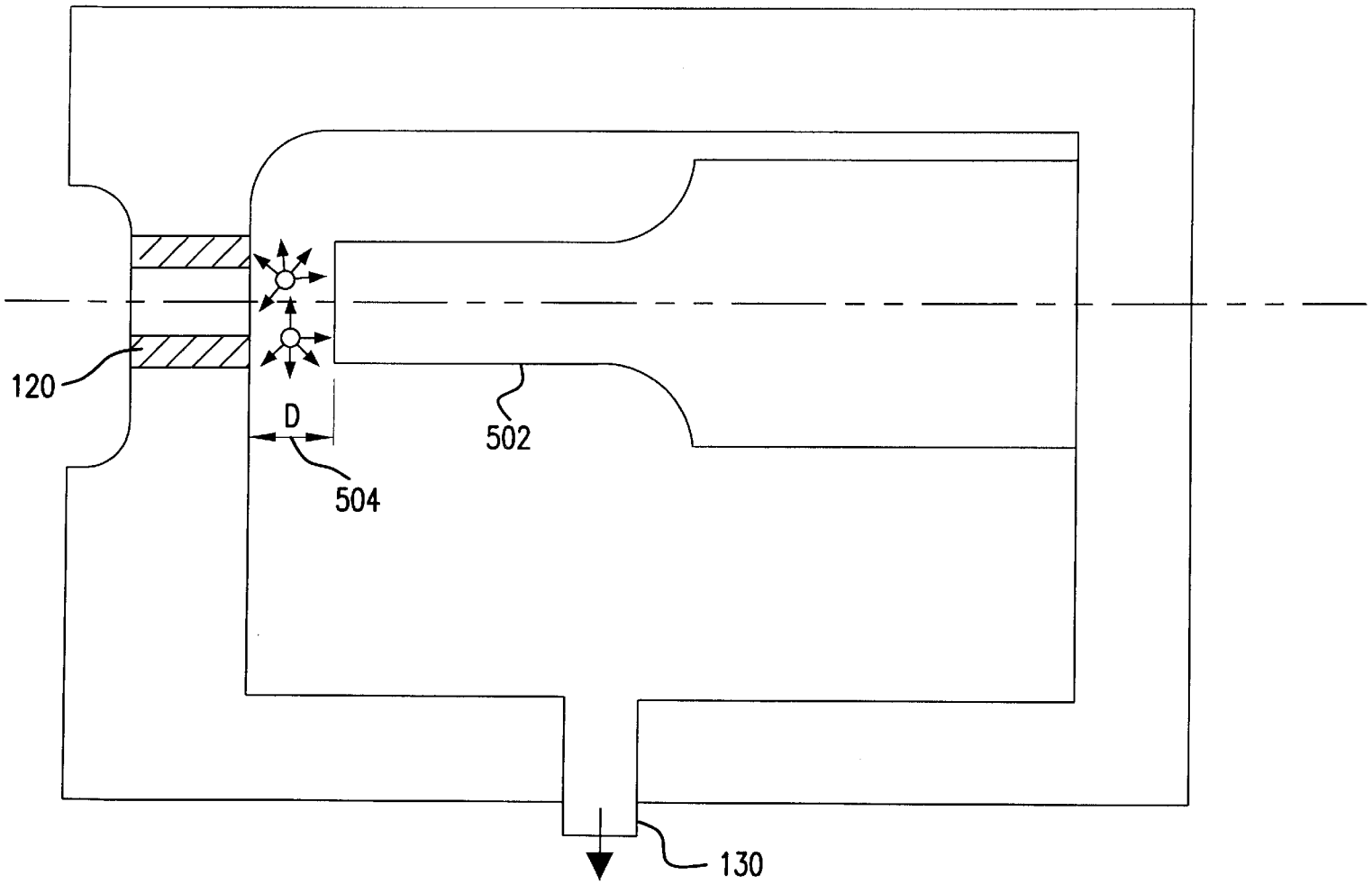
FIG. 5 shows an alternate embodiment of a third chamber of the mill of the present invention in which an ultrasonically vibrating horn is used.

The slurry jet emitted from secondary slurry nozzle 120 is directed toward third chamber 110. A collider 128 is disposed in third chamber 110 directly in the path of the slurry jet. Collider 128 can be a stable collider, such as the screw mechanism shown in FIG. 1. Alternatively, collider 128 could be an ultrasonically vibrating collider 502, as shown in FIG. 5. Ultrasonically vibrating collider 502 can be configured to have a vibration within a range of up to 20,000 Hz or higher. In one embodiment, ultrasonic vibrating collider 502 is the XL2020 Generator, available from Misonix Incorporated, Farmingdale, N.Y. In either embodiment, the position of collider 128 within third chamber 110 is preferably adjustable so that the collider can function to restrict the flow out of secondary slurry nozzle 120 and into third chamber 110. This flow restriction causes increased turbulence to occur in second chamber 106, which further aids in the comminution of the particles.

Figure 11A:
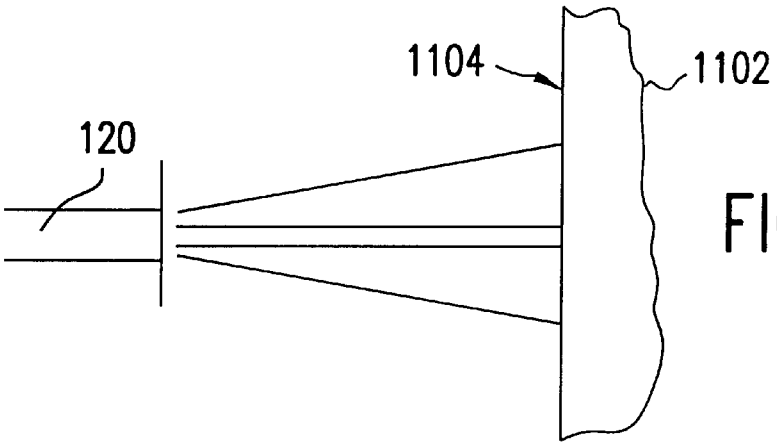
FIGS. 11A and 11B show alternate embodiments of a collider of the present invention.
Figure 11B:
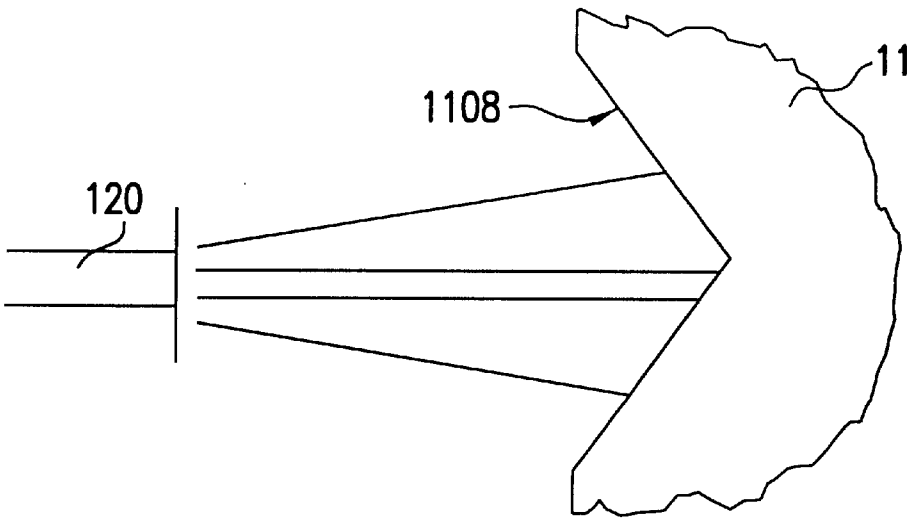

Two embodiments of colliders are shown in FIGS. 11A and 11B. In the embodiment of FIG. 11A, collider 1102 has a front surface 1104 which is the surface that the slurry impacts. In this first embodiment, front surface 1104 is flat. In this embodiment, the slurry exits nozzle 120 and collides with flat front surface 1104. In a second embodiment shown in FIG. 11B, collider 1106 has a front surface 1108 that is concave in the shape of an inverted cone. In this embodiment, as the slurry exits nozzle 120 and collides with front surface 1108, the concave shape causes the particles to bounce off and collide with each other and/or collide with other areas of front surface 1108 to thereby cause further comminution of the particles. It would be apparent to one skilled in the art that the front surface 1108 could be formed in a variety of concave-like shapes to cause the same effect. For example, a hole could be formed in front surface 1108 to cause the particles to further comminute.

In either embodiment, the slurry jet from secondary slurry nozzle 120 directly collides with collider 128 to effect additional comminution of the particles of material in the slurry. As discussed above, the position of collider 128 is preferably positionable at various distances away from secondary slurry nozzle 120. This distance, D, is shown in FIG. 5 and marked with reference number 504. As collider 128 is moved closer to the flow of slurry exiting from slurry nozzle 120, i.e., as D decreases, the flow becomes more restricted. This restricted flow causes turbulence in second chamber 106, which assists with comminution of the particles in that chamber.

Although mill 100 is described with respect to FIG. 1 as an example, mill 100 could be used to achieve the desired particle size without the use of cavitation nozzle 122. In particular, cavitation can be induced in second chamber 106 by creating a pressure differential between the pressure in primary nozzle 118 and the pressure in second chamber 106 of approximately 100:1. Depending on the distance D between collider 128 and secondary slurry nozzle 120, the flow restriction may cause such a pressure differential, which will in turn cause cavitation to be induced in second chamber 106.

Third chamber 110 further has an outlet port 130 disposed at the bottom of the chamber. After the collision between the slurry and collider 128, the slurry flows to the bottom of third chamber 110 and exits via outlet port 130. The mill 100 of the present invention is designed to achieve ultra-fine particles having a resultant size, also referred to as a product size, of less than 15 microns. Preferably, the ultra-fine particles have a product size within a range of 1–5 microns. Still more preferably, the product size of the ultra-fine particles resulting from the use of mill 100 is below 1 micron.

In an alternate embodiment, comminution of the material can be achieved using different combinations of the nozzles and chambers discussed above. For example, in one embodiment, comminution can be achieved using only first chamber 102, primary slurry nozzle 118 and third chamber 110. In an alternate embodiment, comminution can be achieved using only first chamber 102, secondary slurry nozzle 120 and third chamber 110. In another embodiment, multiple nozzles can be used in lieu of primary slurry nozzle 118. The use of multiple nozzles in any portion of mill 100 will help to increase production, i.e., throughput, of mill 100, and will also create more turbulence in the chambers of the mill thereby further increasing the size reduction factor, i.e., the ratio of the feed size of the particles to the product size of the resultant particles, of the mill.

Figure 6:
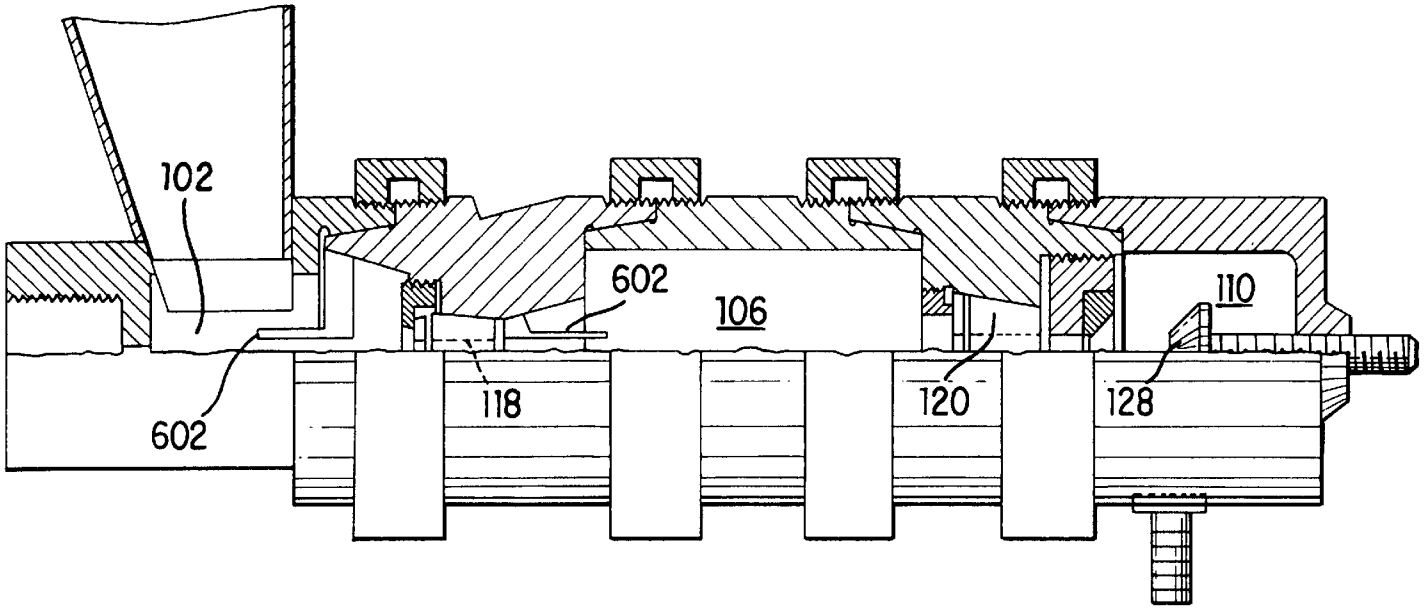
FIG. 6 shows an alternate embodiment of the mill of the present invention in which one or/more self-resonating elements are used.
Figure 6A:
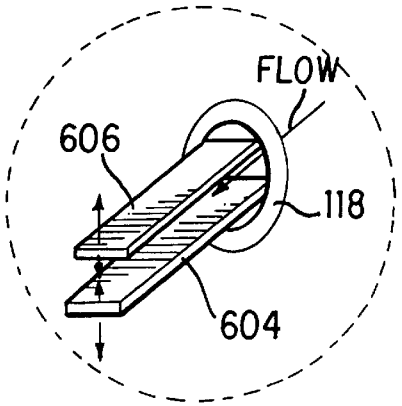
FIG. 6A shows a detailed view of the self-resonating elements of FIG. 6.

In a further embodiment, a self-resonating device 602, as shown in FIG. 6, can be placed throughout mill 100. In the embodiment shown in FIG. 6, beams 604 and 606 of self-resonating device 602, shown in FIG. 6A, are disposed at a certain distance apart from one another and configured to have a self-resonating frequency, such that the amplitude of the movement of beams 604 and 606 will contribute to the comminution process. It would be apparent to one skilled in the relevant art that two or more such beams could be positioned around a center line to create self-resonating device 602.

In the example shown in FIG. 6, self-resonating devices 602 are disposed in first chamber 102 and in front of primary slurry nozzle 118, However, it would be apparent to one skilled in the relevant art that these devices could be placed in a variety of locations in mill 100 to aid in comminution.

In one embodiment, mill 100 may be fitted with sensors to monitor the comminution process, as will be discussed in further detail below with respect to FIG. 4. For example, temperature sensors 132, pressure sensors 134, and sound sensors 136 may be disposed in various areas of each chamber of mill 100. By way of example, these sensors are shown placed in various positions within mill 100 in FIG. 1. For example, temperature sensors 132 are shown disposed in front of nozzle 116, in front of primary slurry nozzle 118, in second chamber 106, and in third chamber 110. Similarly, pressure sensors 134 are disposed in front of nozzle 116, in front of primary slurry nozzle 118 and in second chamber 106, and sound sensors 136 are disposed adjacent the inlet 124 and outlet 126 of second chamber 106.

Temperature and pressure can be measured merely to collect data to keep track of the temperature ranges that occur during the comminution process and to ensure that the pressure created by the various nozzles is sufficient to result in the ultra-fine particles. The sound is measured in second chamber 106 to obtain a reading of how intense the comminution process is in the cavitation chamber. In particular, the frequency of the sound that occurs in this chamber is measured. Typically, the frequency emitted depends on the conditions when cavitation is induced. Frequencies are generally within the range of 500–1000 KHz. In an alternate embodiment, mill 100 can be used in a production line to comminute the material in mass volume. In such a case, the data from the sensors can be fed back to a computer-controlled mill to control the comminution process. An embodiment of this data control system for the mill of the present invention will be discussed in further detail with respect to FIG. 4.

Figure 3:
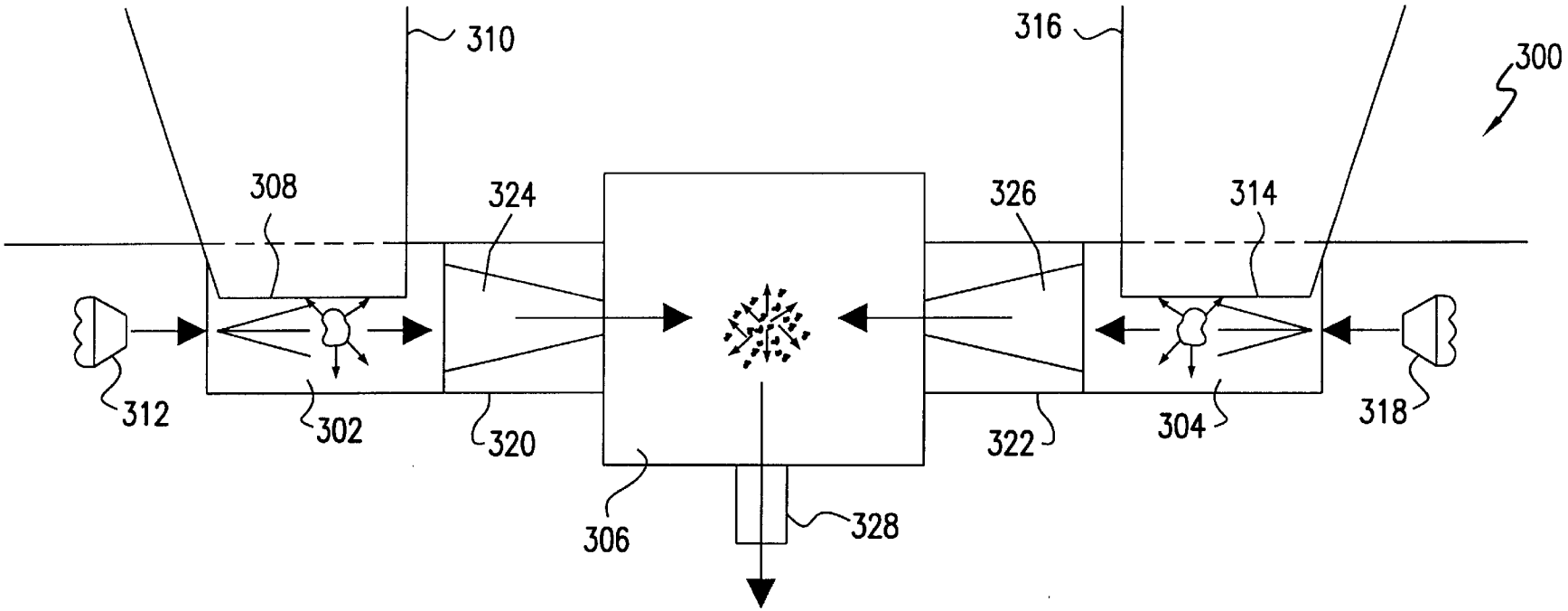
FIG. 3 shows a second embodiment of a mill of the present invention for the comminution of materials.

A second embodiment of a mill 300 is shown in FIG. 3. Mill 300 has a first chamber 302 and a second chamber 304 disposed on opposite ends of a third chamber 306. First chamber 302, similar to first chamber 102, has an inlet 308, a funnel 310, and a high-pressure liquid jet nozzle 312. As described previously in FIG. 1 as the particles of the material travel down funnel 310 and enter first chamber 302 via inlet 308, the liquid jet from nozzle 312 collides or impacts with the particles, thereby breaking them apart. The liquid jet nozzle 312 is oriented in first chamber 302 such that the slurry passes through first chamber 302 and into a nozzle chamber 320.

Nozzle chamber 320 contains a first slurry nozzle 324. First slurry nozzle 324 creates a liquid jet of the slurry created in first chamber 302. Similarly, second chamber 304 includes an inlet 314, a funnel 316, and a liquid jet nozzle 318. The same process occurs in second chamber 304 in which the particles travel down funnel 316 through inlet 314 and are impacted by a jet of liquid from nozzle 318. The slurry from second chamber 304 passes through to a nozzle chamber 322. Nozzle chamber 322 includes a second slurry nozzle 326, which creates a jet from the slurry produced in second chamber 304. The jets from first and second slurry nozzles 324 and 326 are disposed such that they collide with each other in a high velocity collision within third chamber 306. This collision causes further comminution of the particles. The slurry then falls to the bottom of third chamber 306 and exit via an outlet 328. Temperature, pressure and sound sensors, similar to those discussed with respect to mill 100 in FIG. 1, can also be used in mill 300 to acquire data and control the comminution process.

Figure 4:
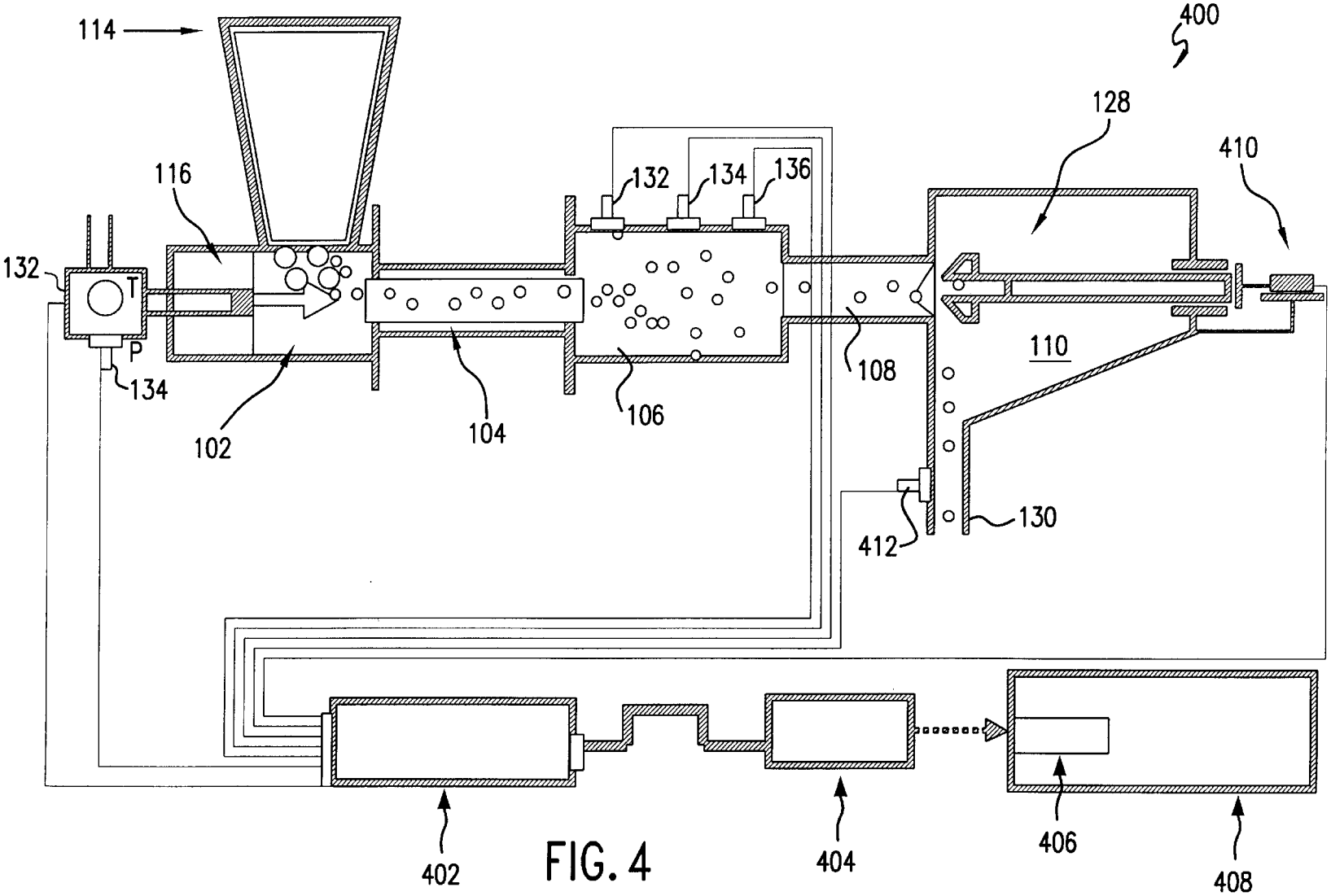
FIG. 4 shows a mill and data control system of the present invention for the comminution of materials.

FIG. 4 shows a mill and data control system 400 of the present invention. The mill of system 400 is similar to mill 100 in that it includes a first chamber 102 in which particles are impacted by a high-pressure liquid jet generated by nozzle 116, a nozzle chamber 104, a second chamber 106 in which cavitation occurs, a second nozzle chamber 108, and a third chamber 110 in which the particles impact a collider for further comminution.

In the mill of FIG. 4, temperature sensor 132, pressure sensor 134 and sound sensor 136 are shown disposed in second chamber 106. In one embodiment, sensors 132, 134 and 136 are implemented using various transducers, thermocouples and user input, as would be apparent to one skilled in the relevant art.

Data collected by each of these sensors are fed into a signal conditioning module 402. In one embodiment, signal conditioning module 402 is a signal conditioner/isolator available from Omega Engineering, Stamford, Connecticut. Signal conditioning module 402 converts the signals transmitted from the sensors 132, 134 and 136 into a computer-readable format and passes them to data acquisition (DAQ) card 404. In one embodiment, DAQ card 404 is a data acquisition card available from National Instruments Corporation, Austin, Texas. The DAQ card 404 can be inserted or disposed in a PCMCIA slot 406 of a processor 408. Processor 408 processes the signals to acquire data regarding the comminution process. In one embodiment, processor 408 is running LabView software that enables the user to view, store and/or manipulate the data received from the sensors to be used as control parameters in the control system.

Figure 7:
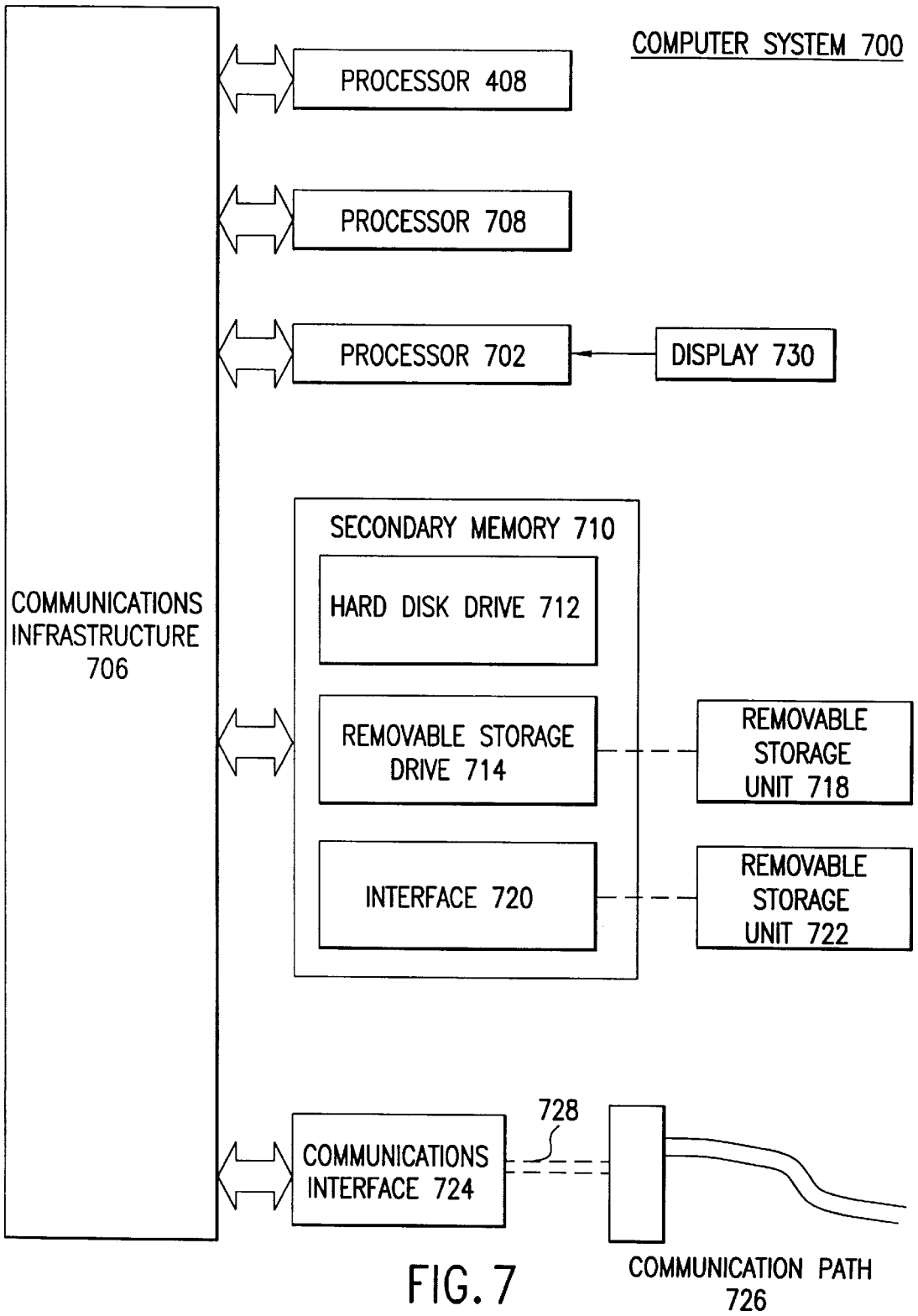
FIG. 7 shows an exemplary computer system used to implement the mill and data control system of the present invention.

It would be apparent to one skilled in the relevant art that the present invention may be implemented using hardware, software or a combination thereof and may be implemented in a computer system or other processing system. In fact, in one embodiment, the invention is directed toward one or more computer systems capable of carrying out the functionality described herein. An example of a computer system 700 is shown in FIG. 7. The computer system 700 includes one or more processors, such as processor 408. Processor 408 is connected to a communication infrastructure 706 (e.g., a communications bus, cross-over bar, or network). Various software embodiments are described in terms of this exemplary computer system. After reading this description, it will become apparent to a person skilled in the relevant art how to implement the invention using other computer systems and/or computer architectures.

Computer system 700 can include a display interface 702 that forwards graphics, text, and other data from the communication infrastructure 706 (or from a frame buffer not shown) for display on the display unit 730.

Computer system 700 also includes a main memory 708, preferably random access memory (RAM), and may also include a secondary memory 710. The secondary memory 710 may include, for example, a hard disk drive 712 and/or a removable storage drive 714, representing a floppy disk drive, a magnetic tape drive, an optical disk drive, etc. The removable storage drive 714 reads from and/or writes to a removable storage unit 718 in a well-known manner. Removable storage unit 718, represents a floppy disk, magnetic tape, optical disk, etc. which is read by and written to by removable storage drive 714. As will be appreciated, the removable storage unit 718 includes a computer usable storage medium having stored therein computer software and/or data.

In alternative embodiments, secondary memory 710 may include other similar means for allowing computer programs or other instructions to be loaded into computer system 700. Such means may include, for example, a removable storage unit 722 and an interface 720. Examples of such may include a program cartridge and cartridge interface (such as that found in video game devices), a removable memory chip (such as an EPROM, or PROM) and associated socket, and other removable storage units 722 and interfaces 720 which allow software and data to be transferred from the removable storage unit 722 to computer system 700.

Computer system 700 may also include a communications interface 724. Communications interface 724 allows software and data to be transferred between computer system 700 and external devices. Examples of communications interface 724 may include a modem, a network interface (such as an Ethernet card), a communications port, a PCMCIA slot and card, etc. Software and data transferred via communications interface 724 are in the form of signals 728 which may be electronic, electromagnetic, optical or other signals capable of being received by communications interface 724. These signals 728 are provided to communications interface 724 via a communications path (i.e., channel) 726. This channel 726 carries signals 728 and may be implemented using wire or cable, fiber optics, a phone line, a cellular phone link, an RF link and other communications channels.

In this document, the terms "computer program medium" and "computer usable medium" are used to generally refer to media such as removable storage drive 714, a hard disk installed in hard disk drive 712, and signals 728. These computerprogram products are means for providing software to computer system 700. The invention is directed to such computer program products.

Computer programs (also called computer control logic) are stored in main memory 708 and/or secondary memory 710. Computer programs may also be received via communications interface 724. Such computer programs, when executed, enable the computer system 700 to perform the features of the present invention as discussed herein. In particular, the computer programs, when executed, enable the processor 704 to perform the features of the present invention. Accordingly, such computer programs represent controllers of the computer system 700.

In an embodiment where the invention is implemented using software, the software may be stored in a computer program product and loaded into computer system 700 using removable storage drive 714, hard drive 712 or communications interface 724. The control logic (software), when executed by the processor 704, causes the processor 704 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s). In yet another embodiment, the invention is implemented using a combination of both hardware and software.

As shown in FIG. 4, a second temperature sensor 132 and pressure sensor 134 are disposed on liquid jet 116 to measure the temperature and pressure of the liquid as it exits liquid jet 116 and enters first chamber 102. The data from these sensors is also fed into signal conditioning module 402 and processor 408.

A linear variable differential transducer (LVDT) 410 is disposed on one end of collider 128 of third chamber 128. LVDT 410 measures the linear position of collider 128 with respect to the slurry flow as it enters third chamber 110. The data from LVDT 410 are also fed into signal conditioning module 402 and processor 408.

Finally, a particle size sensor 412 is disposed in outlet port 130 of third chamber 110 to measure the final size of the particles after mill processing is complete. The data from particle size sensor 412 are also fed into signal conditioning module 402 and processor 408.

Although system 400 of FIG. 4 is shown as only a data acquisition system, it would be apparent to one skilled in the relevant art, that processor 408 could use the data acquired to control mill processing of the mineral particles. In such an embodiment, a feedback loop would be created between processor 408 and each of the chambers 102, 104, 106, 108 and 110 to control the flow and comminution at each stage of the processing.

For example, the user could select the final particle size to be achieved via computer interface, and the data acquired by processor 408 could be used to vary the pressure of the liquid streams through the nozzles and/or to adjust the position of the flow restrictor with respect to the secondary slurry nozzle. In this way, the data acquired can be used to control and accurately maintain the desired product size of the materials being processed.

EXAMPLE

Figure 8:
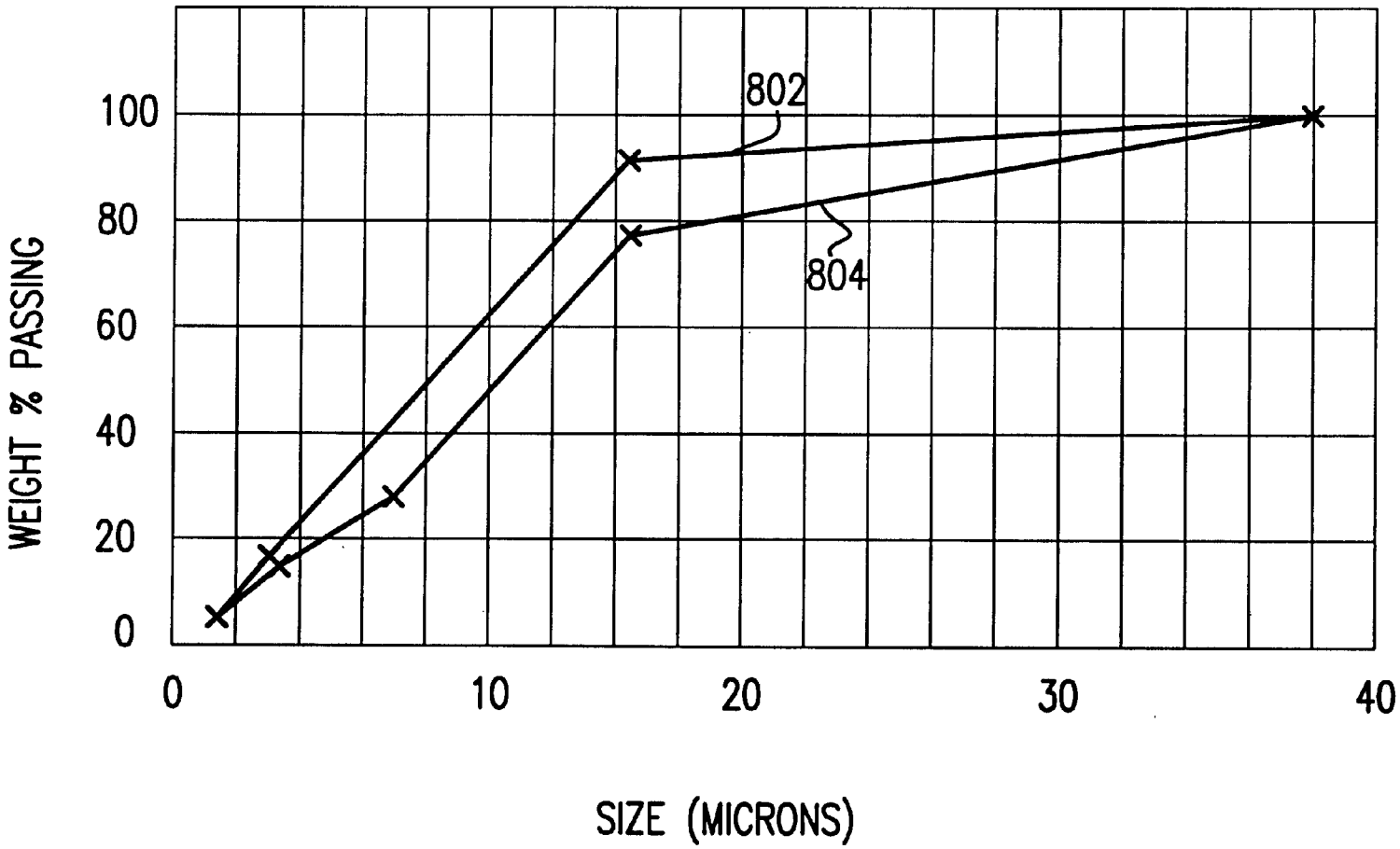
FIG. 8 shows a graph of the product size distribution resulting from use of the mill of the present invention for processing anthracite.

FIG. 8 shows a graph of particle size distribution resulting from use of the mill of the present invention for processing anthracite. In this example, the distribution marked as 802 is based on a feed size of 0.25–0.5 inches. For the distribution marked as 804, the feed size was 0.02–0.05 inches. The test mill included first chamber 102, nozzle chamber 104, second chamber 106 and third chamber 110, as described above with respect to mill 100. The nozzle for high pressure liquid jet 116 had a diameter of 0.012 inches and the primary slurry nozzle of nozzle chamber 104 was 0.045 inches. The liquid pressure for jet 116 used for the particles shown in distribution 802 was 40,000 psi, and the liquid pressure for jet 116 used for the particles shown in distribution 804 was 30,000 psi. Collider 128 in third chamber 110 was in a fully open position.

As shown in the graphs of FIG. 8, for a feed size of 0.25–0.5 inches, the mill of the present invention comminuted approximately 90% of these starting particles to a product size within a range of submicron to 15 microns. For a feed size of 0.02–0.05 inches, the mill of the present invention comminuted approximately 90% of these particles to a product size within a range of submicron to 28 microns.

The mill of the present invention is intended to be used for the comminution of both organic and inorganic materials, including comminution of minerals. In the comminution of certain minerals, such as mica, the resulting particles achieved using the mill of the present invention are in the shape of flakes of minerals. In particular, the mill of the present invention creates flakes or platelets of ultra-fine particles of minerals. The liquid jets cause the liquid to enter the tip of cracks in the minerals, which create tension at the tip. This tension causes the cracks to propagate along the natural plane in the mineral so that small particles of the minerals separate into flakes. As such, the present invention provides a unique shape to these particles, viz, the natural smallest particle of the mineral available. Particles generated using other methods which do not incorporate the comminution techniques of the present invention do not result in flakes because they do not take advantage of the natural cracks in the minerals.

The ultra-fine anthracite particles resulting from processing using the mill of the present invention can be utilized in a variety of applications. For example, the resulting anthracite particles can be used in the following applications: electrodes of metallurgical furnaces; graphite and graphite-based products; carbon black; carbon-based hydrogen storage systems; molds and dies for casting; water trays for chemical vapor deposition processing; electrodes for plasma etching; brushes for electric motors; fuel cells plates, catalysts and electrodes; electrodes for EDM; aerospace and naval structural components; meso-phase carbons for lithium-ion batteries; carbon fibers, whiskers, filaments, tapes and composite materials; molecular sieving carbons; carbon fiber reinforced plastics; activated carbons; activated carbon fibers; fullerenes and carbon nanotubes; diamond-like films; organic chemicals including ethylene, propylene, butadiene, benzene, toluene, xylene and methanol; and engineering polymers and engineering plastics including general engineering plastics such as PET, PBT, PAR, high-temperature heat-resistant plastics, liquid crystalline polymers, functional polymers, condensed polynuclear aromatic resins and inorganic/organic polymers.

While a number of embodiments of the present invention have been described above, it should be understood that they have been presented by way of example, and not limitation. It will be apparent to persons skilled in the relevant art that various changes in form and detail can be made therein without departing from the spirit and scope of the invention. Thus the present invention should not be limited by any of the above-described exemplary embodiments, but should be defined only in accordance with the following claims and their equivalents.

What is claimed is:

1. A method for creating ultra-fine particles of a material using high-pressure liquid jet, comprising:

(a) placing a material in a first chamber;

(b) subjecting the material in the first chamber to a high-pressure liquid jet, whereby at least a portion of the material is divided into particles;

(c) transferring the particles of the material to a second chamber in a continuous high-pressure slurry jet;

(d) subjecting the particles of the material to cavitation in the second chamber, whereby at least a portion of the particles are further divided into relatively smaller particles;

(e) transferring the relatively smaller particles to a third chamber in a continuous high-pressure slurry jet; and (f) causing the relatively smaller particles to collide with a collider in said third chamber, whereby at least a portion of said relatively smaller particles are divided into ultra-fine particles of the material.

2. The method of claim 1, wherein said placing step includes providing a plurality of particles of the material wherein said particles have a feed size of less than 0.5 inches in diameter.

3. The method of claim 1, wherein said placing step includes providing a plurality of particles of the material, wherein said particles have a feed size within a range of 600–1,200 microns in diameter.

4. The method of claim 1, wherein said causing step includes creating ultra-fine particles of the material having a product size of less than 15 microns.

5. The method of claim 1, wherein said causing step includes creating ultra-fine particles of the material having a product size of less than 5 microns.

6. The method of claim 1, wherein said step (b) includes generating the high-pressure liquid jet using a high-pressure liquid jet nozzle having a diameter within a range of 0.005–1.0 inches.

7. The method of claim 6, wherein said step (b) further includes delivering said high-pressure liquid jet at a pressure within a range of 5,000–100,000 psi.

8. The method of claim 1, wherein said step (b) includes generating the high-pressure liquid jet using a high-pressure liquid jet nozzle having a diameter within a range of 0.005–0.060 inches.

9. The method of claim 1, wherein said causing step includes causing the relatively smaller particles to collide with a flow restrictor.

10. The method of claim 1, wherein said causing step includes causing the relatively smaller particles to collide with a flat front surface of the collider.

11. The method of claim 1, wherein said causing step includes causing the relatively smaller particles to collide with a concave front surface of the collider.

12. The method of claim 1, wherein said causing step includes causing the relatively smaller particles to collide with an ultrasonically vibrating tip of the collider.

13. The method of claim 1, wherein said step (c) includes providing a primary slurry nozzle to transfer the particles of the material to the second chamber.

14. The method of claim 13, wherein said step (d) includes attacking the particles exiting said primary slurry nozzle using a cavitation nozzle.

15. The method of claim 1, wherein said step (e) includes providing a secondary slurry nozzle to transfer the relatively smaller particles of the material to the third chamber.

16. The method of claim 15, wherein said step (e) further includes directing the relatively smaller particles of the material at the collider in the third chamber.

17. The method of claim 1, wherein said placing step includes providing a material selected from the group consisting of: solid phase organic and inorganic materials.

18. The method of claim 1, wherein said placing step includes providing a mineral selected from the group consisting of: anthracite, silica carbides, silica compounds, garnet, alumina, coke, coke by-products, magnetite, zinc, copper, brass, nickel, mica, vermiculite, silicon dioxide, and carbon black.

19. A method for creating ultra-fine particles of a material using a high-pressure liquid jet, comprising:

(a) placing a first material in a first chamber;

(b) subjecting the first material in the first chamber to a high-pressure liquid jet, whereby at least a portion of the first material is divided into particles;

(c) placing a second material in a second chamber;

(d) subjecting the second material in the second chamber to a high-pressure liquid jet, whereby at least a portion of the second material is divided into particles;

(e) creating a first jet of slurry of said particles from said first chamber and creating a second jet of slurry of said particles from said second chamber, such that said first and second slurry jets impact each other in a third chamber, whereby at least a portion of said particles are divided into ultra-fine particles of the material.

* * * * *

UNITED STATES PATENT AND TRADEMARK OFFICE

CERTIFICATE OF CORRECTION

PATENT NO. : 6,318,649 B1
DATED : November 20, 2001
INVENTOR(S) : Mazurkiewicz

It is certified that error appears in the above-identified patent and that said Letters Patent is hereby corrected as shown below:

Column 1,
Line 4, before the subtitle BACKGROUND OF THE INVENTION, the following subtitle and paragraph should be entered:

-- STATEMENT REGARDING FEDERALLY-SPONSORED RESEARCH AND DEVELOPMENT

The U.S. Government has a paid-up license in this invention and the right in limited circumstances to require the patent owner to license others on reasonable terms as provided for by the terms of one or more of the following contracts: Contract No. N00014-99-C-0277, Contract No. N00014-01-C-0245, Contract No. N00014-01-C-0448 and Contract No. N00014-02-C-0329 awarded by the Office of Naval Research and Subcontract number 4500011933 awarded by Oak Ridge National Laboratory. --

Signed and Sealed this

Twenty-second Day of April, 2003

JAMES E. ROGAN
*Director of the United States Patent and Trademark Office*